United States Patent [19]

Lahn et al.

[11] Patent Number: 4,834,612

[45] Date of Patent: May 30, 1989

[54] IN A PUMP WHEEL OF A SIDE-CHANNEL FUEL PUMP

[75] Inventors: Bernd-Jürgen Lahn, Jüchen; Raimund Frielingsdorf, Bergisch-Gladbach, both of Fed. Rep. of Germany

[73] Assignee: Pierburg GmbH, Neuss, Fed. Rep. of Germany

[21] Appl. No.: 154,143

[22] Filed: Feb. 9, 1988

[30] Foreign Application Priority Data

Feb. 26, 1987 [DE] Fed. Rep. of Germany ..... 3706170

[51] Int. Cl.[4] ..... F04D 29/66

[52] U.S. Cl. ..... 415/119; 415/55.1; 415/55.7

[58] Field of Search ..... 415/119, 53 T, 213 T, 415/199.2, DIG. 1; 416/194, 195, 196 R

[56] References Cited

U.S. PATENT DOCUMENTS

| | | | |
|---|---|---|---|
| 3,045,969 | 7/1962 | Meienberg | 415/119 |
| 4,130,381 | 12/1978 | Levin et al. | 416/196 R |
| 4,723,888 | 2/1988 | Watanabe et al. | 415/53 T |

FOREIGN PATENT DOCUMENTS

| | | | |
|---|---|---|---|
| 729453 | 11/1942 | Fed. Rep. of Germany | 415/53 T |
| 863345 | 11/1952 | Fed. Rep. of Germany | 416/196 |

*Primary Examiner*—Robert E. Garrett
*Assistant Examiner*—John J. Kwon
*Attorney, Agent, or Firm*—Roberts, Spiecens & Cohen

[57] ABSTRACT

A side channel pump having two side channels for conveying fuel in automobiles is provided with a vane pump wheel in which, for reduction of noise, a plurality of the vanes are connected to each other by webs extending radially inwards from the periphery of the vanes towards the hub. The webs are axially centered midway between the vanes and form ring segments of determined depth which face the side channels of the pump and have a smaller depth than the size of the openings of the side channels.

13 Claims, 2 Drawing Sheets

IN A PUMP WHEEL OF A SIDE-CHANNEL FUEL PUMP

FIELD OF THE INVENTION

The present invention relates to a side channel pump having two side channels for conveying fuel in automobiles and in particular to a pump wheel of the pump provided with radial vanes.

DESCRIPTION OF PRIOR ART

Such a side channel pump is known, for example from DEOS No. 29 31 659. A problem with these pumps is that they generate noise due to the fact that they are mounted in the fuel tank of the automobile.

SUMMARY OF THE INVENTION

An object of the present invention is to provide a pump which is driven by an electric motor and is so constructed that the disturbing development of noise is substantially avoided.

The above and further objects of the invention are chieved by providing a particular construction of a pump wheel in side channel pump to reduce the noise without substantial loss of pump efficiency.

In accordance with the invention, the pump wheel includes a hub and a plurality of radial blades or vanes extending from the hub in circumferentially spaced relation such that adjacent vanes define cells therebetween and webs extending between and connected to selected adjacent vanes to serve as a means to prevent the production of pressure pulsations and consequent noise. The webs have outer edges which are coextensive with the vanes at the periphery of the vanes and the webs extend radially inwards towards the hub over a pre-determined distance representing a minor portion of the radial extent of the vanes. In this way, the webs form ring segments of a given depth.

The cells without webs are open and in a particular embodiment the vanes of every second cell are provided with webs.

In order to permit communication of the side channel at the inlet side of the pump wheel with the side channel at the outlet side of the pump wheel, open cells as described are provided and additionally the webs preferably extend radially over a distance which is less than the width of the opening of the side channels facing the pump wheel.

BRIEF DESCRIPTION OF THE FIGURES OF THE DRAWING

One embodiment of the invention is shown diagrammatically in the drawing, wherein.

DETAILED DESCRIPTION OF A PREFERRED EMBODIMENT

Figure 1:
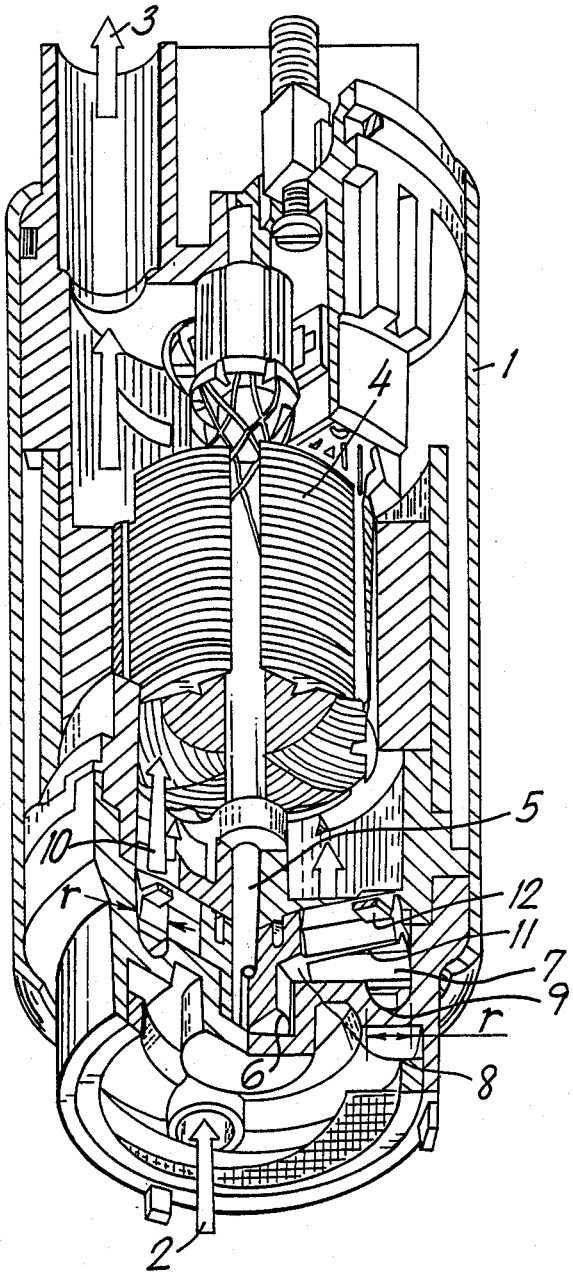
FIG. 1 is a perspective view, partly broken away and in section, of a side channel pump according to the invention suitable as a fuel pump.

FIG. 1 illustrates a fuel pump 1 having a fuel inlet 2 and a fuel outlet 3. An electric motor 4 has a drive shaft 5 coupled to a pump or impeller wheel 6 to drive the wheel in rotation. The pump wheel 6 has a plurality of radial blades or vanes 7 which extend from a hub 8 in circumferentially spaced relation. Between adjacent vanes are formed cells 11 which face the fuel inlet 2 which opens proximate the hub 8. Since the conveying action of side channel pumps is based on the centrifugal effect exerted by the impeller wheel on the fluid being conveyed, gases formed from the fuel collect in the vicinity of the hub 8 and the heavier fuel collects at the periphery of the impeller wheel i.e., of the entire pump mechanism. In order to remove the gases which form, gas vent openings (not shown) are provided.

In accordance with the invention, between selected adjacent vanes 7 there are provided webs 12 which extend radially inwards from the periphery of the impeller wheel. The webs 12 are axially centered midway between the radial vanes and their outer edges are coextensive with the peripheral edges of the vanes 7 so as to be flush therewith. The webs 12 extend radially inwards by a distance d towards the hub 8. The body of the pump is provided with two side channels 9, 10 and the radial extent d of the webs 12 is less than the extent of the side channels 9, 10 at their juncture with the pump wheel as denoted by r in FIG. 1.

Figure 2:
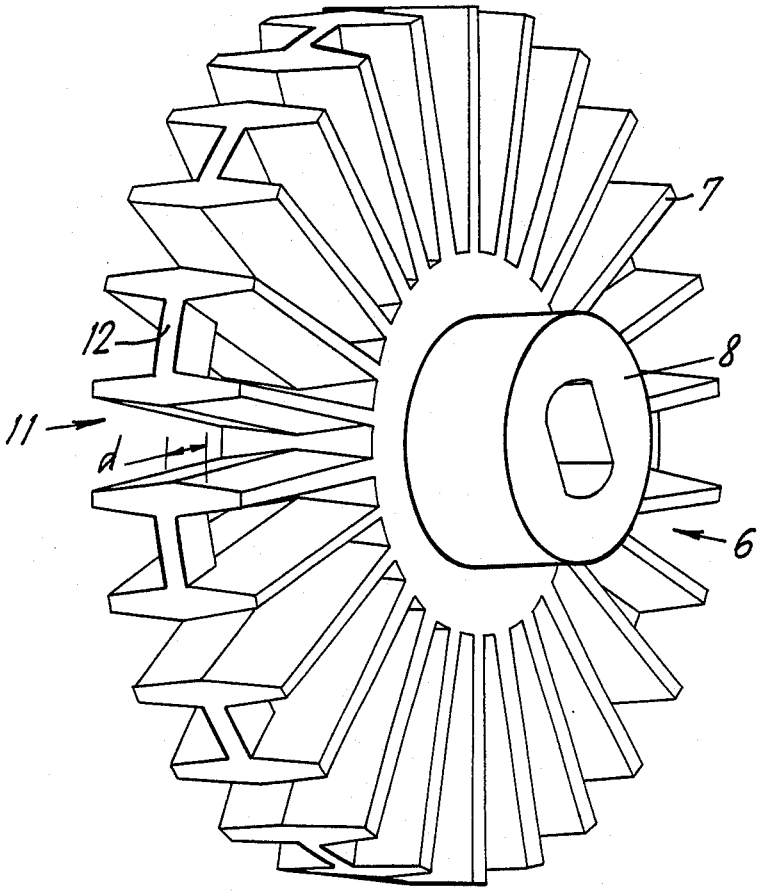
FIG. 2 is a perspective view, on enlarged scale, of a pump wheel of the pump.

As shown in FIG. 2 by way of example, the vanes 7 of each second cell 11 are connected to each other by a web 12. However, any other suitable division of the impeller wheel by webs connecting the vanes is also possible.

The desired effect of the invention is obtained due to the fact that in a pump having two side channels 9, 10 extending perpendicular to the central plane of the impeller wheel, vortices of the pumped fluid are formed which enter into each side channel and due to the rotation of the impeller wheel the vortices travel helically in opposite directions of rotation to one another and meet in the center plane of the impeller wheel. This meeting of the formed vortices leads to the production of pressure pulsations which manifest themselves as a disturbing noise. This effect is reduced by the provision of the webs 12 in accordance with the invention. Since the fluid being conveyed must, however, be able to pass from the side channel 9 which is arranged on the inlet side to the side channel 10 which is arranged on the outlet side, it is not possible to arrange webs 12 between every cell over the entire periphery of the impeller wheel. Moreover, the radial extent of the webs must be selected in such a way that the passage of the fuel is possible without substantial loss in efficiency. The number and width of the webs 12 which connect the vanes are optimized to provide minimum development of noise and maximum delivery capacity. In the embodiment shown, the webs 12 are placed in every other cell 11 and the webs extend radially between 10 and 25% of the radial extent of the vanes.

Although the invention has been described in relation to a preferred embodiment thereof, it will become apparent to those skilled in the art that numerous modifications and variations can be made within the scope and spirit of the invention as defined in the appended claims.

What is claimed is:

1. A side channel pump having two side channels for conveying fuel in automotive vehicles comprising a pump wheel including a hub and a plurality of radial vanes extending from hub in circumferentially spaced relation, adjacent vanes defining cells therebetween, and webs extending between and connected to selected adjacent vanes, said webs extending radially inwards from the periphery of the pump wheel towards said hub over a predetermined distance representing a portion of the radial extent of the vanes to form ring segments of a given depth, a number of cells without connecting webs being present between vanes with connecting webs.

2. A pump as claimed in claim 1 wherein said webs are axially centered midway between the radial vanes.

3. A pump as claimed in claim 2 wherein said webs have outer edges which are coextensive with the outer edges of the vanes.

4. A pump as claimed in claim 2 wherein a number of cells without connected webs are present between vanes with connecting webs.

5. A pump as claimed in claim 1 wherein the two side channels have openings facing said pump wheel which are of an extent greater than the extent of the webs in the radial direction. radial vanes extending from said hub in circumferentially spaced relation, adjacent vanes defining cells therebetween, and webs extending between and connected to selected adjacent vanes, said webs extending radially inwards from the periphery of the pump wheel towards said hub over a predetermined distance representing a portion of the radial extent of the vanes to form ring segments of a given depth, a number of cells without connecting webs being present between vanes with connecting webs.

6. A pump as claimed in claim 1 wherein the ring segments have a thickness less than said depth for minimizing noise in the pump.

7. A pump as claimed in claim 6 wherein said depth of the ring segments is between 10 and 25% of the radial extent of the vanes.

8. A side channel pump having two side channels for conveying fuel in automotive vehicles comprising a pump wheel including a hub and a pluraltiy of radial vanes extending from said hub in circumferentially spaced relation, adjacent vanes defining cells therebetween, and webs extending between and connected to selected adjacent vanes, said webs extending radially inwards from the periphery of the pump wheel towards said hub over a predetermined distance representing a portion of the radial extent of the vanes to form ring segments of a given depth, said webs being connected to the vanes of every second cell.

9. A pump as claimed in claim 8 wherein said webs are axially centered midway between the radial vanes.

10. A pump as claimed in claim 9 wherein said webs have outer edges which are coextensive with the outer edges of the vanes.

11. A pump as claimed in claim 8 wherein the two side channels have openings facing said pump wheel which are of an extent greater than the extent of the webs in the radial direction.

12. A pump as claimed in claim 8 wherein the ring segments have a thickness less than said depth for minimizing noise in the pump.

13. A pump as claimed in claim 12 wherein said depth of the ring segments is between 10 and 25% of the radial extent of the vanes.

* * * * *